US006338815B1

(12) United States Patent
Seng

(10) Patent No.: US 6,338,815 B1
(45) Date of Patent: Jan. 15, 2002

(54) STEEL CABLES DRIVEN FURNACE TOP CHUTE FEEDER FOR BLAST FURNACE

(76) Inventor: Quansong Seng, Room 208, Building 34, Dongzhimenwai Street, Beijing (CN), 100027

( * ) Notice: Subject to any disclaimer, the term of this patent is extended or adjusted under 35 U.S.C. 154(b) by 0 days.

(21) Appl. No.: 09/459,787

(22) Filed: Dec. 13, 1999

(30) Foreign Application Priority Data

Jun. 13, 1997 (CN) ..... 97104499

(51) Int. Cl.[7] ..... C21B 7/08
(52) U.S. Cl. ..... 266/199; 414/206
(58) Field of Search ..... 266/197, 199, 266/187; 414/206

(56) References Cited

U.S. PATENT DOCUMENTS 4,360,305 A * 11/1982 Dorsch ..... 266/183
5,738,822 A * 4/1998 Lonardi et al. ..... 266/199
6,004,090 A * 12/1999 Axelsson ..... 414/206

FOREIGN PATENT DOCUMENTS

GB 1403467 A * 8/1975
GB 1403687 A * 8/1975

* cited by examiner

*Primary Examiner*—Scott Kastler
(74) *Attorney, Agent, or Firm*—Darby & Darby

(57) ABSTRACT

The present invention relates to a furnace top distribution device used for blast furnace and in particularly, to a furnace top chute feeder driven by steel cables. The chute feeder comprises a system for oscillating said chute which consists of steel cable and assembly pulley, and directional limit means for vertically translation, which consists of vertical guide posts, directional limit roller for vertical translation, adjustable supports, shafts of said supports and adjustable screws for adjusting hold-down degree of the rollers, etc., and an AC permanent-magnet servomotor controlled by an AC servodriver is used as an actuating motor for chute oscillating. The chute feeder is simple in structure and has homogeneous driving force. It operates smoothly and can be worked and maintained easily. It has a strong reliability and a high positioning accuracy. So the distributor can better meet the needs of distribution process.

10 Claims, 3 Drawing Sheets

STEEL CABLES DRIVEN FURNACE TOP CHUTE FEEDER FOR BLAST FURNACE

TECHNICAL FIELD

The present invention relates to a distributor device provided at the top of a blast furnace, in particular, to a steel cables driven chute feeder which is provided at the top of a blast furnace. This kind of chute feeder can be used for a blast furnace operated under high pressure or normal pressure. It is also suitable for various shaft furnaces which are required for special distribution of bulk material.

BACKGROUND TECHNIQUE

Currently, there are mainly two kinds of the charging devices for blast furnace, i.e., bell type one and chute type one. The latter is also referred to as bell-less type charging device. Such chute type distributor exhibits following advantages: it has flexible distribution of the bulk material and excellent tightness. Therefore, the chute feeder has been widely popularized in the large-scale blast furnace immediately after it has been proposed. A distributor device is described in for example, such as British Patent Nos. GB 1403687 and GB 1403467, in which planetary differential transmission is provided. However, the construction of said mechanism is quite complex so that it is not easy to produce in cost-effective manner. In addition, its maintenance cost is high. Therefore, Such distributor is not a perfect one which can be used widely.

Chinese patent No. 85109284, entitled "Hydraulically driven distributor device" and Chinese patent No. 86104673, entitled "distributor device" both have equivalent performance to the above-mentioned chute feeder with planetary differential transmission. Moreover, these distributor devices are superior to the planetary differential transmission chute feeder in production, installation, maintenance and equipment investment, etc. However, these hydraulically driven devices involve a problem in the respect of liquid-electric power conversion. In addition, the hydraulically driven system is a huge equipment with complex construction so that its investment expenditure is still relatively high.

DISCLOSURE OF THE INVENTION

Therefore, a primary object of the invention is to provide an economic and practical chute feeder for blast furnace with simplified structure.

Another object of the invention is to provide a furnace top chute feeder for blast furnace, in which a steel cable-assembly pulley transmission mechanism is arranged instead of the prior art hydraulically driven mechanism so that the chute feed would have a simplified and more compact structure and is stable and durable while it can be produced with lower cost. Moreover, its control accuracy is so high that various requirements for the distribution process for blast furnace can be sufficiently satisfied. Therefore, the chute feeder according to the invention is appreciated to be popularized.

According to the invention, there is provided a furnace top chute feeder for blast furnace, mainly comprising: a transmission-case cover; a transmission-case body carrying said transmission-case cover; a water cooled base provided beneath said transmission-case body for receiving the water used to cool a rotary sleeve and a choke; directional limit means for vertical translation provided for reciprocating a vertically translational large bearing while keeping it in the horizontal state; and chute distributing means for feeding the charge material into the furnace chamber of blast furnace, comprising a chute for carrying the charge into the furnace chamber, a chute carriage for supporting the chute, and a chute rotary system for rotating the chute in the furnace at a certain angle, the characterized in that, it further comprising chute oscillatory system for changing continuously or step by step the angle a between the chute and the axis of the rotary sleeve in a certain range by means of steel cable-assembly pulley transmission, said chute oscillatory system can either make the chute oscillate independently or make the chute oscillate in combination with the rotation of the chute.

According to an aspect of the invention, said chute oscillatory system comprises: a steel cable winding drum on which a drag steel cable is wound; chute oscillatory reduction gear for transferring the power resulting in the chute oscillatory motion to said steel cable winding drum; a plurality of upper fixed pulley provided on the transmission-case cover; a vertically translational large bearing, the inner ring of which can be rotated and its outer ring can only be translated upwardly and downwardly; a plurality of movable pulley spaced uniformly along the periphery of the backing ring of the vertically translational large bearing, these movable pulley being pulled by the drag steel cable coming from said steel cable winding drum so that the vertically translational large bearing can be translated up and down; a backing ring of the vertically translational large bearings; a crank tailing wheel frame; a connection shaft for mounting said crank tailing wheel frame on the inner ring of said vertically translational large bearing, crank tailing wheels provided at the rear portions of the cranks respectively and located in the guide groove formed in the crank tailing wheel frame; a movable pulley pulled by said drag steel cable; and a steel cable which is passed through said upper fixed pulleys and passed around a plurality of movable pulleys arranged on the backing ring of the vertically translational large bearing, respectively so as to form a closed ring.

Moreover, the number of said movable pulleys is n, where n is 2–4; the number of the pairs of the upper fixed pulleys mounted on the transmission-case cover is 2n, where n is 2–4; and the number of the movable pulleys fixed on the transmission-case cover is 2n, wherein n is 2–4. The movable pulleys n are arranged in two fashion: coaxial arrangement and in-line planar arrangement.

According to one preferred embodiment of the present invention, a fixed pulley for changing the movement direction of the drag steel cable one time is provided on the bottom portion of said transmission-case body.

According to another preferred embodiment of the invention, an assembly pulley for pulling said drag steel cable is provided. The assembly pulley includes two parallel lower fixed pulley and a movable pulley fixed on the pedestal of said movable pulleys.

In addition, said directional limit means for vertical translation includes a plurality of vertical guide posts arranged uniformly along the periphery of the transmission-case body of the chute feeder, a plurality of directional limit rollers for vertical translation arranged between the backing ring of the vertically translational large bearings and vertical guide posts, the number of which corresponds to vertical guide posts, adjustable supports of directional limit rollers of vertical translation provided on a plurality of corresponding strengthening ribs of the backing ring of the vertically translational large bearings, support shafts, and adjusting screws for adjusting the extent of compressing of the rollers, wherein the number of the vertical guide posts is in the range of 6 to 12, the directional limit rollers for vertical translation are provided with 6 to 12 in pairs correspondingly, and the strengthening ribs are provided for 6 to 12.

Moreover, a motor for diving the chute to oscillate is a AC permanent-magnet servo motor controlled by a AC servo actuator.

BRIEF DESCRIPTION OF THE DRAWINGS

The present invention may be better understood and its numerous objects and advantages will become apparent to those skilled on the art by reference to the accompanying drawing in which.

BEST MODE FOR CARRYING OUT THE INVENTION

Figure 1:
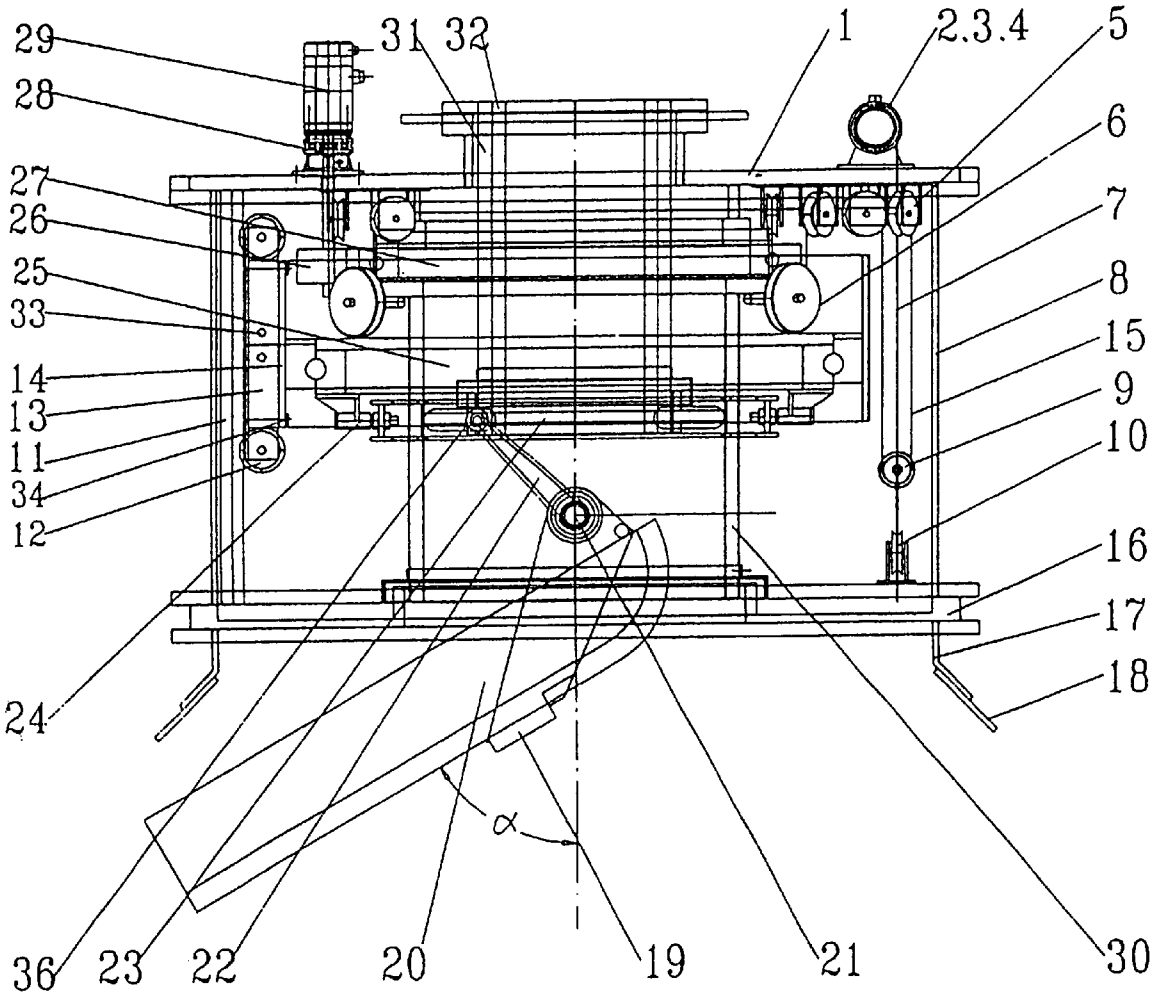
FIG. 1 is a schematic view of a steel cables driven furnace top chute feeder for blast furnace according to one embodiment of the invention.
Figure 2:
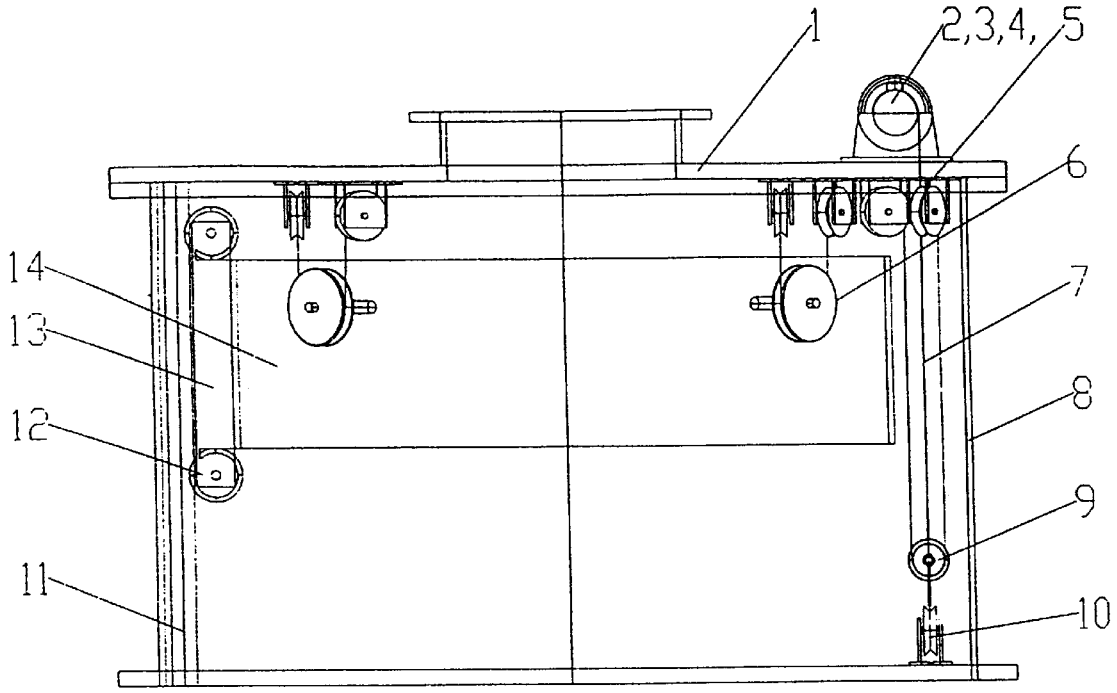
FIG. 2 is an elevation view of vertically translating mechanism driven by steel cables.
Figure 3:
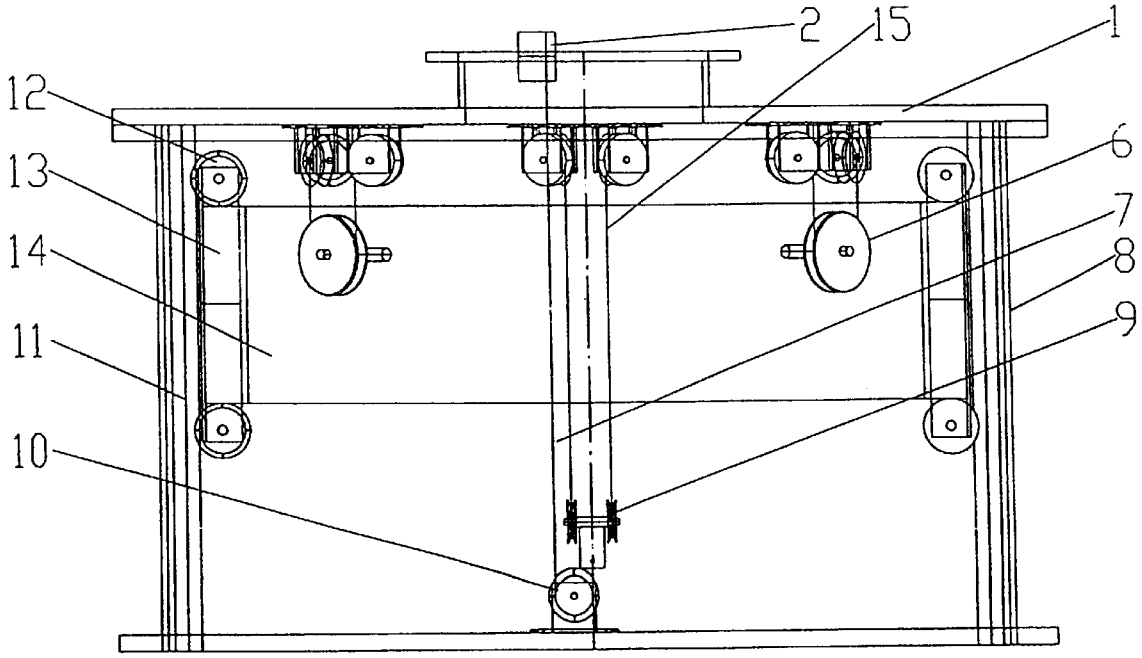
FIG. 3 is a side view of vertically translating mechanism driven by steel cables.
Figure 4:
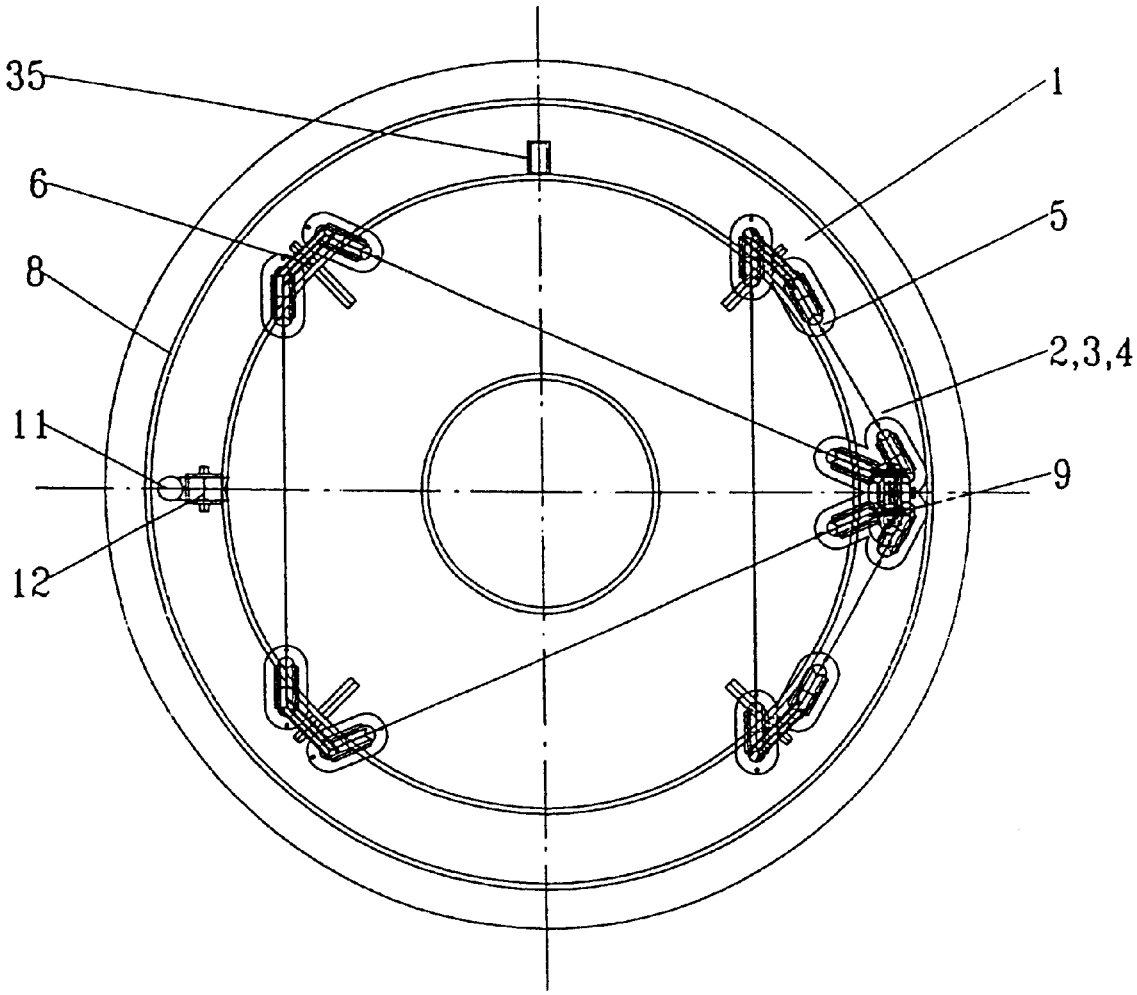
FIG. 4 is a bottom plan view of vertically translating mechanism driven by steel cables.

As shown in the drawings, the invention provides a chute feeder provided at the top of blast furnace and driven by steel cables.

It is well known that the furnace top chute feeder for blast furnace is provided on the top cone of a blast furnace and is connected with a charge tank at its top end. The use of such a chute feeder is to supply scientifically the charge material stored in the charge tank into furnace in accordance with the requirements of the smelting process of blast furnace.

The chute feeder driven by a steel cable is a cylindrical box-like apparatus, and the center line of the chute feeder coincides with that of the blast furnace. The charge is passed through the choke arranged at the center area of the chute feeder along the center line of the furnace and fallen on the chute. After that, the charge slides to the charge surface of the furnace throat through the rotating chute. In order to satisfy the requirements of the smelting process of blast furnace, it is required that the chute can either be rotary or oscillatory.

As shown in the drawings, a transmission case is mounted on the top cone of the blast furnace. A large flange of its body 8 is butt joined to a top ring 17. A water cooled base 16 is provided between the transmission-case body 8 and the top ring 17, the function of which is to receive the water used to cool a rotary sleeve 30 and a choke 31 and discharge the cooled water out off the transmission-case body through a discharge pipe provided thereon so that the heat transferred from the inside of the furnace via heat-absorbing surfaces is brought away and various mechanical parts in the transmission case are thus kept to operate normally and are prevented from possible damage caused by high temperature.

According to the invention, the furnace top chute feeder mainly comprises a transmission-case cover 1 mounted on the transmission-case body 8, the water cooled base 16, the rotary sleeve of the chute 30, the choke 31, a wear-resistant bushing of the choke 32, directional limit means for vertical translation and two drive systems which can be operated either independently or in combination.

The chute rotary system comprises: a motor 29 for driving the chute to rotate, a reduction gear 28, a driver pinion 26, an upper hanging bearing 27 with its inner ring fixed on the transmission-case cover 1, the chute rotary sleeve 30 fixed on the outer ring of the upper hanging bearing 27, lugs 21, a chute carriage 19 hanged in the lower portion of the rotary sleeve 30 by means of lugs 21, and a chute 20 engaged in the chute carriage 19.

Two symmetrically arranged lugs 21 are projected out the rotary sleeve 30 and extended into the transmission case. Two cranks 22 are provided respectively and symmetrically at each end portion of the projected lugs. Said two cranks have the same length and extend parallelly to each other. The angle of the cranks is determined by the angle of the chute after assembly.

Also, the chute oscillatory system further comprises: a chute oscillatory actuator motor 4, a chute oscillatory reduction gear 3, a steel cable winding drum 2 provided on the transmission-case cover, drag steel cable 7, closed-ring steel cable 15, lower fixed pulley 10, four movable pulleys 6 provided at the periphery of a backing ring of a vertically translational large bearing, eight upper fixed pulleys arranged at the inside of the transmission-case cover 1 and corresponding to the four movable pulleys 6, two movable pulleys 9 for dragging the steel cable coming from the fixed pulleys 5, the backing ring of the vertically translational large bearing 14, a vertically translational large bearing 25, the inner ring of which can be rotate and its outer ring can only be translated up and down, a crank tailing wheel frame 23, connection shafts 24 for connecting said crank tailing wheel frame to the inner ring of said vertically translational large bearing, and crank tailing wheels 36 provided at the rear portions of the respective cranks respectively and located in the guide grooves formed in the crank tailing wheel frame 23.

Since the crank tailing wheel frame 23 is secured on the inner ring of the vertically translational large bearing by means of the pivots 24 along the center line of the rotary sleeve 30 and vertically to the connection line of the centers of the tailing wheels, the direction of the extension of the pivots 24 are vertical to the axial direction of the tailing wheels and crosses the latter in a plane. Such a structure has the function of a universal joint. Therefore, this structure can eliminate strong destructive power due to inconsistent in the length of cranks, the cranks not being parallel to each other, lugs not extending in the horizontal direction, rotary sleeves not being vertical or coaxial, and the like. The inner ring of the vertically translational large bearing can be rotated by the roller provided on one of the two pivots for connecting the crank tailing frame to the inner ring of the vertically translational large bearing being turned via a poke groove formed on the rotary sleeve. The rotary movement of the inner ring of the vertically translational large bearing is a passive rotary movement. As long as the rotary sleeve is rotated together with the chute, the inner ring of the vertically translational large bearing is rotated.

The major portion of the above-mentioned chute oscillatory system is arranged in the transmission case, except that the steel cable winding drum 2, reduction gear 3 and the actuator motor 4 are mounted at the outside of said transmission case. The reduction gear 3 and the actuator motor 4 are arranged in a special motor house away from the transmission case of the chute feeder so that the operation environment of the motor can be improved and the lift time of the motor can be thus extended.

In order to make the vertically translational large bearing to translate vertically, directional limit means for vertical translation is provided, which includes the backing ring of the vertically translational large bearings 14, the strengthening ribs of the backing ring of the vertically translational large bearings 35, adjustable supports 13 of the directional limit rollers of vertical translation, support shafts 33 of the adjustable supports of directional limit rollers of vertical translation, adjusting screws 34 for adjusting the extent of compression of the directional limit rollers of vertical translation, eight vertical guide posts 11 spaced apart uniformly along the cylindrical wall of the transmission-case body, and a plurality of directional limit rollers for vertical translation.

Next, the operation mechanism of the chute rotary system will be described. In operation, the pinion 26 is rotated by the actuator motor 29 through the reduction gear 28, and the pinion 26 brings the large gear integrated with the outer ring of the upper hanging bearing 27 into rotation so that the chute rotary sleeve 30 coaxial with the large gear, i.e., with the outer ring of the upper hanging bearing 27 and fixed together and the lugs 21 which are secured on the sleeve, together with the chute carriage 19 hanging at the lugs 21 and the chute 20 engaging at the chute carriage 19, are rotated around the center line of the blast furnace, thus the rotation of the chute is achieved.

The power generated by the chute oscillatory actuator motor 4 is transferred through the reduction gear 3 and the steel cable winding drum 2 so that the steel cable 7 is dragged. Then the steel cable 7 drags the movable pulleys 6 of the backing ring of the vertically translational large bearing via the lower fixed pulley 10, movable pulleys 9 and upper fixed pulleys 5. The vertically translational large bearing 25 is thus moved up and down so that the crank tailing wheel frame 23 is brought to move up and down. Therefore, the crank 22 is pulled via the crank tailing wheels 36 so as to make it rotate around the lugs 21 while the chute carriage 19 is rotating around the lugs 21. The angle of rotation is in the range of 0°–60°. The vertical position of the chute 20 is set to be 0°. Therefore, the chute 20 is oscillated in a angle of $\alpha$. The upward swing of the chute 20 is obtained by the dragging of the steel cable 7 and its downward swing is achieved by its own gravity. Under the natural suspended balance point of the chute 20, the chute is forced to fall down by means of the weights of the vertically translational large bearing 25, the backing ring of the vertically translational large bearing 14, the crank tailing wheel frame 23 and the like until to be 0°, that is, the chute is in its vertical position.

The chute 20 can be rotated. Meanwhile, the chute 20 can be swung by the up-and-down linear movement of the vertical translational large bearing 25 being changed to the swing of the chute carriage 19 and the cranks around the lugs. The rotation of the chute 20 is a separate movement independent of the oscillatory movement of the chute 20. However, these movements can be carried out separately or in combination. The cross point of the two movements is in the balls of the vertically translational large bearing 25.

In order to make the vertically translational large bearing 25 to be moved up and down smoothly and stably, in addition to the limit means consisted of eight vertical guide posts 11 and eight pairs of adjustable directional limit rollers for vertical translation 12, it is quite necessary to make the circumferential tension of the backing ring of the vertical translational large bearing 14 uniform. For this purpose, the following measures are taken: 1. four movable pulleys 6 are secured uniformly on the periphery of the backing ring of the vertical translational large bearing 14; 2. four pairs of the upper fixed pulleys 5 are arranged on the transmission-case cover 1 correspondingly; a steel cable is passed through the four pairs of the upper fixed pulleys 5 and passed around four movable pulleys 6 of the backing ring of the vertical translational large bearing 25, respectively so that a closed-ring steel cable 15 is formed. When the close-ring steel cable is passed through four pairs of upper fixed pulleys, four sides will be formed. Two opposite sides are pulled toward two pairs of fixed pulleys which are collectively arranged on the transmission-case cover 1 and then pulled toward movable pulleys 9. The movable pulleys 9 are connected to and pulled by the steel cable 7 which is unwound from the steel cable winding drum 2 so that the movable pulleys 9 will drag the close-ring steel cable 15. Thus, the close-ring steel cable 15 drags the movable pulleys 6 of the backing ring of the vertical translational large bearing 14 so that each of the four movable pulleys 6 are subject to the action of the close-ring steel cable 15 and operated synchronously. The two dragging manner of the steel cable 7 are described as below. One is that a fixed pulley 10 is arranged at the lower portion of the transmission-case body 8 so that the steel cable 7 will change its direction of extension only one time and wind the steel cable winding drum 2 directly. The other dragging manner is that such a assembly pulley is arranged that the lower fixed pulley 10 is composed of two fixed pulleys and a further movable pulley is arranged at the movable pulleys 9. The steel cable 7 will change its direction of extension many times when it passes such assembly pulley so that the drag force will be reduced to one fourth of the former manner, the winding length of the steel cable 7 will be increased three times and the winding turns of the steel cable winding drum 2 will be also increased three times, thus the power of the chute oscillatory actuator motor 4 can be reduced and the positioning accuracy of the chute can be improved.

The steel cable winding drum 2 is driven by a AC permanent-magnet numerical control servo motor. Since such kind of motor has good speed regulation performance, the control accuracy of the chute oscillation made by the steel cable transmission mechanism is superior to the oscillatory positioning accuracy of the prior art.

While preferred embodiments have been shown and described, various modifications and substitutions may be made thereto without departing from the spirit and scope of the invention. Accordingly, it is to be understood that the present invention has been described by way of illustration and not limitation.

Exploitation in Industry

The present invention has the following advantages:

1. The use of the steel cable-assembly pulley transmission can ensure the vertical translational bearing to move stably and smoothly without jamming and creeping so that the problem of the prior art, i.e., the three hydraulic cylinders need to be synchronized, can be solved completely;

2. Compared to the planetary differential transmission or the hydraulic transmission, the structure of the chute feeder according to the invention can be manufactured at lower cost since its structure is simpler and it is easy to be maintained. Moreover, the chute feeder of the invention has higher reliability.

3. The AC servo actuator used for precision numerical control machine is used to drive the chute oscillatory system. As compared with the hydraulic transmission or normal motor drive, positioning accuracy is high due to in the absence of electric-hydraulic conversion. There still have further advantages in the present chute feeder, such as the motor has large and constant output torque with small volume and is free of maintenance; the response time is extremely short; the speed regulating range is wide; the chute oscillatory system of the invention can be subject to repeated over load; the performance of operation at lower speed is good; the noise is low; it is suitable for operation in the severe conditions, such as work in dusty environment, high temperature or humid environment; integrated cellular structure is easy to be mounted, maintained and replaced, has high reliability and consistency, and has perfect protection performance.

4. Since the hydraulic station of the prior art oscillatory system is deleted, the equipment weight of the present chute feeder is reduced so that the amount of investment is decreased.

To sum up, the furnace top chute feeder according to the invention is durable and stable with simpler and more compact structure and economic cost. In addition, its control accuracy is so high that the requirements for distribution process for blast furnace can be sufficiently satisfied. Therefore, the chute feeder according to the invention is appreciated to be popularized.

What is claimed is:

1. A furnace top chute feeder used for blast furnace, mainly comprises:

a transmission-case cover (1);

a transmission-case body (8) carrying said transmission-case cover;

a water cooled base (16) provided beneath said transmission-case body and used for receiving the water for cooling a rotary sleeve (30) and a choke (31);

directional limit means for vertical translation provided for reciprocating a vertically translational large bearing (25) while keeping it in the horizontal state;

chute distributing means for feeding the charge material into the furnace chamber of blast furnace, comprising a chute (20) for carrying the charge into said furnace chamber, and a chute carriage (19) for supporting said chute; and a chute rotary system for rotating said chute (20) in the furnace at a certain angle, the characterized in that, it further comprising a chute oscillatory system for changing continuously or step by step the angle ($\alpha$) between said chute (20) and the axis of said rotary sleeve in a certain range by means of a steel cable-assembly pulley transmission, the cables being located outside the oven, said chute oscillatory system can either make said chutes swing independently or make said chute swing in combination with the rotation of said chute.

2. A furnace top chute feeder as claimed in claim 1, wherein said chute oscillatory system comprises:

a rope winding drum (2) on which a drag rope (7) is wound;

chute oscillatory reduction gear (3) for transferring the power as a result of the chute oscillatory motion to said rope winding drum;

a plurality of upper fixed pulley (5) provided on said transmission-case cover (1);

a vertically translational large bearing (25), the inner ring of which can be rotated and its outer ring can only be translated up and down;

a plurality of movable pulleys (6) spaced apart uniformly along the periphery of said backing ring of said vertically translational large bearing (14), these movable pulleys being pulled by said drag rope (7) unwound off said rope winding drum so that said vertically translational large bearing can be translated up and down;

said backing ring of said vertically translational large bearings (14);

a crank tailing wheel frame (23);

connection shafts (24) for mounting said crank tailing wheel frame on the inner ring of said vertically translational large bearing;

crank tailing wheels (36) provided at the rear portions of the cranks respectively and located in the guide grooves formed in said crank tailing wheel frame (23);

a movable pulley (9) pulled by said drag rope (7); and a steel cable (15) which is passed through said upper fixed pulleys (5) and passed around a plurality of movable pulleys (6) arranged on said backing ring of said vertically translational large bearing, respectively so as to form a closed ring.

3. A furnace top chute feeder as claimed in claim 2, wherein the number of said movable pulleys (9) is n, where n is 2–4; there are 2n pairs of said upper fixed pulleys (5) mounted on said transmission-case cover (1), where n is 2–4; and the number of said movable pulleys (6) is 2n, wherein n is 2–4.

4. A furnace top chute feeder as claimed in claim 3, wherein n of said movable pulleys (9) can be arranged in two fashion: coaxial arrangement and in-line planar arrangement.

5. A furnace top chute feeder as claimed in claim 2, wherein a fixed pulley (10) for changing the movement direction of said drag rope (7) one time is provided on the bottom portion of said transmission-case body (8).

6. A furnace top chute feeder as claimed in claim 1, wherein an assembly pulley for pulling said drag rope is provided, which includes two parallel lower fixed pulleys (10) and a movable pulley fixed on the pedestal of said fixed pulleys (9).

7. A furnace top chute feeder as claimed in claim 1, wherein said directional limit means for vertical translation includes a plurality of vertical guide posts (11) arranged uniformly along the periphery of said transmission-case body (8) of said chute feeder, a plurality of directional limit rollers for vertical translation (12) arranged between said backing ring of vertically translational large bearings (14) and vertical guide posts (11), the number of which corresponds to said vertical guide posts, adjustable supports (13) of said directional limit rollers of vertical translation provided on a plurality of corresponding strengthening ribs (35) of said backing ring of vertically translational large bearings (14), support shafts (33), and adjusting screws (34) for adjusting the extent of compressing of said rollers.

8. A furnace top chute feeder as claimed in claim 7, wherein the number of said vertical guide posts (11) is in the range of 6 to 12, said directional limit rollers for vertical translation (12) are correspondingly provided for 6 to 12 pairs, and the number of said strengthening ribs (35) is 6 to 12.

9. A furnace top chute feeder as claimed in claim 1, wherein an actuator motor (4) for diving the chute feeder to swing is an AC permanent-magnet servo motor controlled by an AC servo actuator.

10. A furnace top chute feeder as claimed in claim 2, wherein said pulley for changing the movement direction of said drag rope one time is provided on the bottom portion of said transmission-case body.

* * * * *